US005852827A

United States Patent [19]

Lear

[11] Patent Number: 5,852,827

[45] Date of Patent: Dec. 29, 1998

[54] BABY WRAPPING BLANKET

[75] Inventor: Laura Lear, 38 El Cencerro, Rancho Santa Margarita, Calif. 92688

[73] Assignee: Laura Lear, Rancho Santa Margarita, Calif.

[21] Appl. No.: 880,845

[22] Filed: Jun. 23, 1997

[51] Int. Cl.[6] ..... A41B 13/06

[52] U.S. Cl. ..... 2/69.5; 5/482; 2/69; 2/80; 128/873

[58] Field of Search ..... 5/482, 494, 658; 2/69, 69.5, 80, 83; 128/873, 872, 869

[56] References Cited

U.S. PATENT DOCUMENTS

| | | | |
|---|---|---|---|
| D. 109,371 | 4/1938 | Friedman . | |
| D. 109,830 | 5/1938 | Ford . | |
| D. 117,521 | 11/1939 | Friedman . | |
| D. 118,956 | 2/1940 | Friedman . | |
| D. 149,696 | 5/1948 | Segerman . | |
| D. 259,531 | 6/1981 | Prouty et al. . | |
| 1,723,644 | 8/1929 | Collingbourne . | |
| 2,227,751 | 1/1941 | Idelman | 2/84 |
| 2,989,753 | 6/1961 | Burner | 2/69.5 |
| 3,034,132 | 5/1962 | Landsberger et al. | 2/69.5 |
| 3,361,132 | 1/1968 | Rentsen, Jr. | 128/873 |
| 3,412,407 | 11/1968 | Key | 2/69.5 |
| 3,693,190 | 9/1972 | Hickling | 2/69.5 |
| 3,739,399 | 6/1973 | Sheahon | 2/69.5 |
| 3,854,156 | 12/1974 | Williams | 5/284 |
| 4,125,903 | 11/1978 | Farrell | 2/69.5 |
| 4,172,300 | 10/1979 | Miller | 5/424 |
| 4,254,900 | 3/1981 | Wheeler | 224/158 |
| 4,783,855 | 11/1988 | Njegovan | 2/69.5 |
| 4,853,996 | 8/1989 | Marrigan et al. | 5/494 |
| 4,897,885 | 2/1990 | Lunt | 2/69.5 |
| 5,046,204 | 9/1991 | Mohler | 5/413 |
| 5,129,406 | 7/1992 | Magnusen et al. | 128/873 |
| 5,535,449 | 7/1996 | Dickey | 2/69.5 |

*Primary Examiner*—Alexander Grosz
*Attorney, Agent, or Firm*—Richard L. Myers

[57] ABSTRACT

An article for wrapping a baby or infant and adapted to keep the infant warm and secured. The article for wrapping the infant comprising a sheet of flexible material having an inner surface for receiving the infant and an outer surface. The sheet of flexible material is configured to include a central area which extends between a first side and a second side. A first side flap extends outwardly from the first side and the central area to a first side flap end. In a similar configuration, a second side flap extends outwardly from the second side to a second side flap end. A slit is disposed in the central area and extends between the inner surface and the outer surface. The first side flap is configured to be wrapped around the infant, inserted through the slit and secured to the outer surface. The second side flap is configured to be wrapped around the infant and over the previously folded first side flap.

20 Claims, 1 Drawing Sheet

BABY WRAPPING BLANKET

FIELD OF THE INVENTION

This invention relates generally to blankets for covering individuals and more particularly, to a blanket for wrapping around a baby or a small infant.

BACKGROUND OF THE INVENTION

It is well known that babies and small infants should be kept warm and securely covered. This is particularly true in the first few months of life when the baby is making its transition from leaving the mother's womb. In addition, babies and infants are vulnerable to outdoor weather conditions because of their small size and inability to recognize the dangers of exposure and cold temperatures. Exposure, in particular, to cold temperatures, drafts and chills are more likely to cause colds and complications such as pneumonia and other respiratory illnesses in the baby or infant.

Various outer wrap clothing and covers are available for keeping babies and infants warm as well as for protection against exposure to cold temperatures. As is well known, small blankets may be used with babies and infants to keep them warm. Typically, these blankets, which are specially configured, are wrapped around the infant and pinned or otherwise tucked into place to protect the infant from becoming cold. Wrapping an infant in this manner not only keeps the infant warm, but also helps confine the infant, making it easier to handle and carry and reduces the risk of injury to the infant. However, since infant blankets are not tailored to fit each infants form, they may be cumbersome, difficult to secure and frequently fall open. In addition, many babies and infants have a tendency to kick with their legs resulting in the blanket be kicked open or even off. Every time the blanker or covering is opened or removed, the infant is potentially exposed to cold, drafts and chills.

Another limitation of current baby and infant blankets is that it is often difficult to partially open a blanket once the child is wrapped within. In particular, many of these blankets include buttons, pins and other devices which are somewhat cumbersome to open. In addition, many of these blankets are not configured for being partially opened. Thus, there is a need for a baby and infant wrapping blanket which may be partially opened to adjust to various temperature and other conditions.

It is often desirable to tightly wrap the baby or infant in the baby blanket. By being tightly wrapped, the baby or infant may feel more secure while maintained a warm environment. However, current baby and infant blankets are typically not capable of securely surrounding the baby or infant in a comfortable fashion. These blankets include a number of folds, fastening devices such as buttons and clips which prevent a tight and comfortable fit around the baby or infant. There is thus a need for a baby and infant wrapping blanket which is free from uncomfortable fastening devices and which can securely and comfortably surround a baby or infant.

SUMMARY

The present invention provides an article for wrapping a baby or infant for maintaining proper body temperature as well as to securely confine the wearer. By providing a sheet of fabric made from a thermally insulative material, the baby may be wrapped and kept comfortably warm. The present invention also provides an article for wrapping a baby or an infant which is simple, safe and inexpensive to use.

The present invention is generally directed to an article for wrapping a baby or infant. For purposes of this invention, the terms baby and infant shall be interchangeable. Thus, the term infant refers both to infants and to babies.

The article generally comprises a sheet of flexible material which has an inner surface for receiving the infant and an outer surface. The sheet of flexible material also includes a central area which extends between a first side and a second side. The central area also includes a slit which is disposed between the first side and the second side. The slit extends between and connects the inner and outer surfaces.

A first side flap extends outwardly from the first side and the central area to a first side flap end. This first side flap is configured for folding around the infant and for inserting through the slit. The slit allows the first side flap to be tightly pulled around the infant without the use of buttons, clips, or other fasteners. A second side flap extends outwardly from the second side and the central area to a second side flap end. This second side flap is configured for folding over a portion of the first side flap and the infant.

An upper edge extends from the first side flap across to the second side flap. In a similar fashion, a lower edge extends from the first side flap to the second side flap. The lower edge may be configured with a pocket for receiving a portion of the infant such as the feet.

The slit is preferably configured as a vertical slit disposed between the first and second sides of the central area. The vertical slit generally comprises a predetermined length and may even include a predetermined width. The slit is configured such that the first side flap end of the first side flap may be passed through to secure the infant against the inner surface of the central area. Preferably, the vertical slit is disposed closer to the second side flap than the first side flap.

A fastener, such as a velcro may be attached to the outer surface of the central area and also on the inner surface of the first side flap end for releasably retaining the first side flap end to the outer surface of the central area.

In another aspect of the present invention, the article for wrapping an infant may comprise a horizontal slit disposed between the first side of the central area and the second side of the central area. Similar to the vertical slit previously described, the horizontal slit is configured to receive the first side flap end for securing the baby or infant against the inner surface of the central area.

In yet another aspect of the present invention, the article for wrapping an infant includes a collar which is removably connected to the upper edge of the central area. The collar is interchangable as a padded collar, a decorative collar or a hood, and can be used to add style to the blanket as well as to protect the infant and to provide warmth.

A method for wrapping a baby wrapping blanket around an infant according to the principles of the present invention includes the steps of providing an baby wrapping blanket made from a sheet of fabric, the sheet having a central area which extends between a first side and a second side. A first side flap extends outwardly and away from the central area to a first side flap end. A second side flap extends outwardly from the second side and the central area to a second side flap end. The central area includes an inner surface for receiving the infant and an outer surface with a slit extending through the inner surface to the outer surface.

The infant is then placed against the inner surface of the central area. The first side flap is folded over the infant such that the side flap covers a portion of the infant, such as the torso. The first side flap end may then be extended through the slit in the central area. The first side flap end is then secured to the outer surface of the central area using a securing device such as Velcro. The second side flap is then folded around the infant such that the second side flap covers a portion of the first side flap. The second side flap is then secured to the outer surface of the central area using a second securing device, such as Velcro.

The invention, together with the additional features and advantages thereof, will become more apparent to those of skill in the art upon reading the description of the preferred embodiments, which follows in this specification, taken together with the following drawings.

DESCRIPTION OF THE PREFERRED EMBODIMENTS

Figure 1:
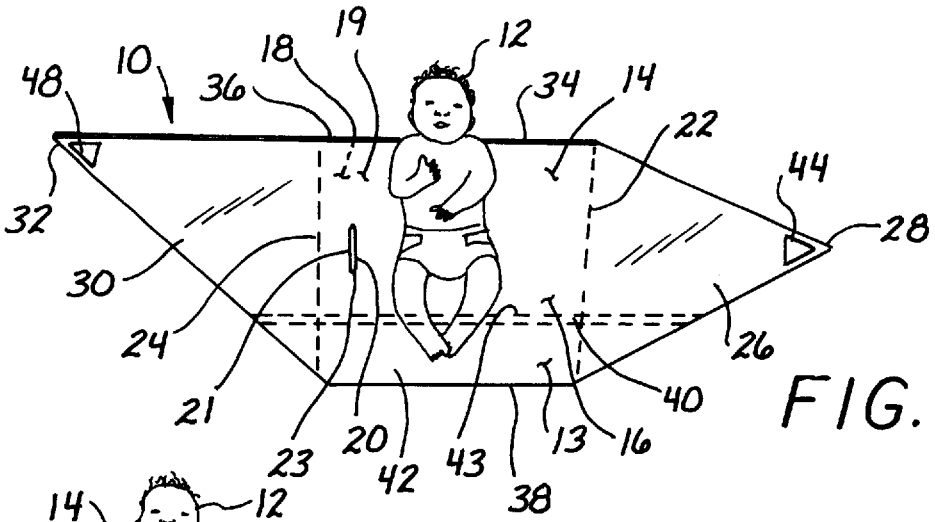
FIG. 1 is a top view of a baby wrapping blanket for wrapping an infant in accordance with the principles of the present invention showing an infant placed within the central area.

Referring now to the drawings, wherein like reference characters designate identical or corresponding parts throughout the several views and embodiments, an article for wrapping and covering an infant according to the present invention is illustrated in FIG. 1 and designated by the reference numeral 10.

As shown in FIG. 1, a baby 12 may be placed on the infant blanket or wrap 10. The blanket 10 may be made from a sheet of flexible material 13 such as a cloth material. The blanket 10 may also be made from layers of such material. For example, the blanket 10 may comprise a first layer of soft cloth material and a second layer made from a plastic or easy to clean cloth. Preferably, the blanket 10 comprises a single sheet of such material.

The blanket 10 includes a central area 14 and has a inner surface 16 and an outer surface 18. The central area 14 is preferably generally centrally located across the inner surface 16 and is configured for receiving the infant 12. The inner surface 16 may be provided with a liner 19. This liner 19 may be provided only within the central area 14 or across any portion of the inner surface desired. In addition, the liner 19 may be removably attached to the inner surface 16. In the removable configuration, the liner may include a soft absorbent cloth and have a plastic of other liquid tight base material. Preferably, the inner surface 16 and the liner 19, if provided, comprise a soft material for comfortable contact with the infant 12.

A slit 20 extends through the blanket 10 from the inner surface 16 to the outer surface 18. The slit 20 is preferably disposed between a first side 22 of the central area 14 and a generally opposed second side 24 of the central area 14.

A first side flap 26 extends outwardly from the first side 22 of the central area 14 to a first side flap end 28. Preferably, this first side flap 26 generally tapers away from the first side 22 and into the first side flap end 28. In this way, the first side flap 26 may have a generally triangular shape. However, other tapering shapes and configurations may be used. The first side flap 26 and the first side flap end 28 are generally configured such that they may be passed through the slit 20.

A second side flap 30 extends outwardly from the second side 24 of the central area 14 to a second side flap end 32. The second side flap 30 is configured for folding over a portion of the first side flap 26 which has been previously folded over the infant 12. The second side flap 30 may also taper away from the second side 24 and into the second side flap end 32 such that the second side flap 30 has a generally triangular shape. However, as with the first side flap 26, different configurations and tapers may be used. Preferably, the second side flap 30 tapers toward the second side flap end 32 from a lower edge 38 of the sheet of material 13. It is important that the second side flap 30, in conjunction with the first side flap 30, be sufficiently sized and configured to cover the torso of the infant 12.

Figure 2:
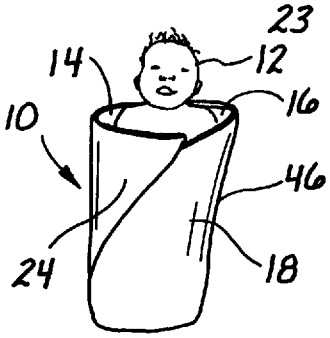
FIG. 2 is a perspective view of the baby wrapping blanket in FIG. 1 shown wrapped around the infant.

An upper edge 34 extends along the sheet of material 13 from the first side flap 26 to the second side flap 30. This upper edge 34 is generally configured for contact with the infant 12 as shown in FIGS. 1 and 2. Preferably, the upper edge 34 includes a hem 36. The hem 36 may incorporate padding, a softer cloth material, an easy to clean material or any other material which is comfortable and non-abrasive against the infant 12.

The lower edge 38 also extends along the sheet of material 13 from the first side flap 26 across to the second side flap 30 and is generally opposed to the upper edge 34. In a similar fashion to the upper edge 34, the lower edge 38 may be provided with a hem 40 for comfortable contact with the infant 12.

The lower edge 38 may be configured with a pocket 42 for receiving a portion of the infant 12. The pocket 42 may be sufficiently deep that a portion of the infant may be maintained and even secured within. Preferably, the pocket 42 may comprise an open portion 43 within the hem 40 of the lower edge 38. Securement straps, an elastic band or elastic materials, tie downs, as well as booties may be provided within the pocket 42, or alternatively as part of the pocket 42.

The pocket 42 is configured to maintain the feet and possibly a portion of the legs of the infant 12 warm as well as generally secure. This may be particularly advantageous if the infant 12 has a tendency to kick. In addition, the pocket 42 prevents the infant 12 from sliding out from within the infant blanket 10.

Referring now to FIGS. 1 and 2, the infant blanket 10 will be described in greater detail. Particularly, the slit 20 within the central area 14 will be described. Preferably, the slit 20, which may merely be a cut or slice within the sheet of flexible material 13, is oriented vertically. In this orientation, the slit 20 is generally perpendicular to the upper edge 34 and the lower edge 38. Preferably, the slit 20 is a generally straight cut, but may be curved to allow better passage of the first side flap 26 and improved comfort for the infant 12.

As previously mentioned, the slit 20 is configured such that the first side flap 26 may be folded over an infant 12 which has been placed against the inner surface 16 of the central area 14, and the first side flap end 28 inserted therethrough. The first side flap end 28 may then be pulled through the slit 20 such that the first side flap 26 is pulled taut and secured around the infant 12. Thus, the slit 20 must be have a slit length 21 sufficient to receive the first side flap end 28. Preferably, the slit length 21 is sufficiently long to receive the first side flap end 28 and a portion of the first side flap 26. This is particularly important with a smaller infant 12 where more of the first side flap 26 must pass through the slit 20. Preferably, the slit 20 is approximately between two and six inches in length and more preferably between two and four inches in length.

The slit 20 may also comprise a slit width 23. As previously mentioned, the slit may merely be a cut or slice within the sheet of flexible material 13. Preferably, this cut or slice comprises hemmed or otherwise finished edges. However, the slit 20 may also be provided with a space between opposing sides of the slit 20 to define the slit width 23. A slit 20 having a slit width 23 may be preferable when using a sheet of material 13 having a thickness or a plurality of layers.

The slit 20 is preferably disposed closer to the second side 24 of the central area 14 than to the first side 22. This placement of the slit 20, in conjunction with its vertical orientation, allows the first side flap 26 to be pulled snug around the infant 12. Preferably, the slit 20 is disposed in the sheet of material 13 such that the infant 12 may be placed within the central area 14 just to the side of the slit 20.

A first fastener 44 may be attached to the first side flap 26 for attachment to the outer surface 18. Preferably, the first fastener 44 is secured to the inner surface of the first side flap end 28. In this configuration, the first side flap end 28 may be passed through the slit 20 and fastened to the outer surface 18 using the first fastening device 44.

Preferably, the first fastening device 44 comprises a portion of hook and pile material such as Velcro. A mating portion of the hook and pile material may be provided on the outer surface 18 for connection with the hook and pile material on the first side flap end 28. Alternatively, buttons, ties, hooks, snaps or other fastening devices may also be used. As will be described below, the first side flap end 28 may be provided without any fastening device such that it may be secured with the second side flap 30.

Figure 3:
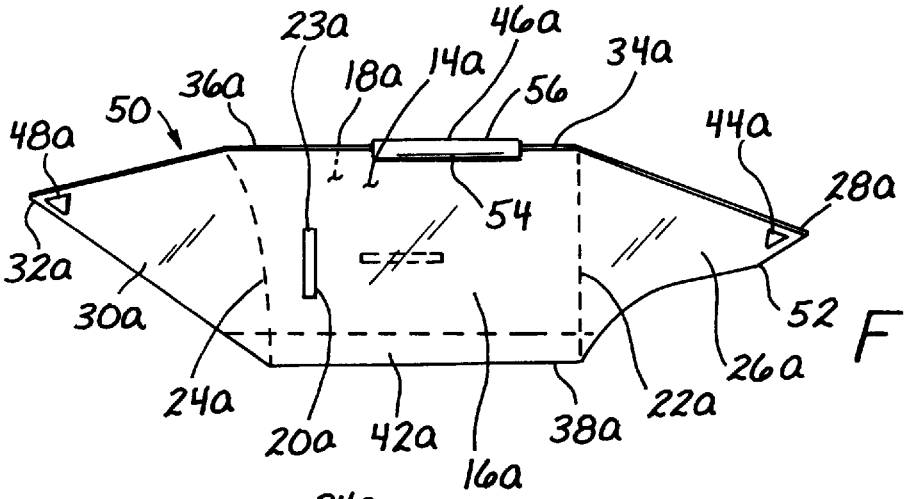
FIG. 3 is a top view showing an alternative embodiment of the baby wrapping blanket of FIG. 1.
Figure 4:
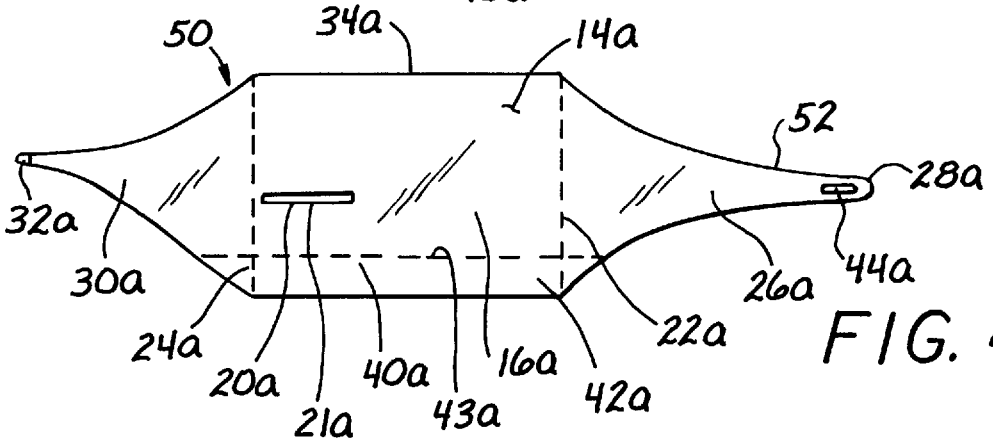
FIG. 4 is an alternative embodiment of a baby wrapping blanket according to the principles of the present invention.

Referring now to FIGS. 3 and 4, alternative embodiments of an article for wrapping an infant 50 constructed in accordance with the principles of the present invention is shown. In this embodiment, like features to those of the previous embodiment are designated by the reference numerals, succeeded by the letter "a". In these embodiments, the article for wrapping an infant is generally designated as 50.

Similar to the previous embodiment, the infant blanket 50 comprises a sheet of material 13*a* having an inner surface 16*a* and an outer surface 18*a*. A first side flap 26*a* extends outwardly and away from a central area 14*a* to a first side flap end 28*a*. In a similar fashion, a second side flap 30*a* extends out from an opposing side of the central area 14*a* to a second side flap end 32*a*. However, in this embodiment, the first side flap 26*a* and the second side flap 30*a* may be configured differently from that described in the previous embodiment.

More particularly, the first side flap 26*a* may include a first elongate portion 52. This first elongate portion 52 may be configured such that it may be passed through a slit 20*a* disposed between the first side flap 26*a* and the second side flap 30*a*. Preferably, the slit 20*a* may be disposed vertically within the central area 14*a* as previously described. However, this slit 20*a* may also be disposed in a horizontal orientation, as best illustrated in FIG. 4. When using a horizontal slit 20, the first side flap 26*a* is preferably elongated as also illustrated in FIG. 4.

The second side flap 30*a* may be configured similar to that of the previously described. However, the second side flap 30*a* may also be configured such that it tapers from both the upper edge 30*a* and the lower edge 38*a*. Preferably, this taper is configured such that the second side flap end 32 is disposed closer to the upper edge 34*a* than the lower edge 38*a*, as best illustrated in FIG. 3. In this configuration, the second side flap 30*a* may be folded over ah infant without covering the infant's neck or creating obstructions.

An attachment 54 may be coupled to the sheet of material 13*a*. The attachment 54 may be used to increase the warmth, comfort or even the safety of the infant 12. Alternatively, the attachment 54 may merely be for decorative or fashion purposes. Preferably, the attachment is removably attached to the sheet of material 13*a*. In one configuration, the attachment is a collar 56 which is attached to the upper edge 34*a* as illustrated in FIG. 3. Alternatively, the attachment may be a hood, padding, supports or similar. Attachment may be made using hook and pile material, fasteners or any other method as is known to those of skill in the art.

Referring now to FIGS. 1 through 3, a method for wrapping an infant wrapping article around an infant according to the principles of the present invention will be described. The method first includes the step of providing an infant wrapping article 10 made from a sheet of fabric material 13 which includes a central area 14 extending on one side 22 to a first side flap 26 and on an opposing side 24 to a second side flap 30. The first and second side flaps 26 and 30 each extend outwardly to a corresponding first side flap end 28 and a second side flap end 32. The central area 14 includes an inner surface 16 for receiving the infant 12 and an outer surface 18. A slit 20 within the central area 14 extends between the inner surface 16 and the outer surface 18. The slit 20 is configured for receiving and passage of the first side flap end 28 and a portion of the first side flap 26. A collar, hood or other attachment 54 may be attached as previously described.

The infant 12 may be placed on the inner surface 16 of the central area 14. The step of placing the infant 12 against the inner surface 16 may include inserting a portion of the infant 12, particularly the infant's feet, into the pocket 42. The first side flap 26 may then be folded over the infant 12. As the first side flap 26 is folded over the infant. The first side flap end 28 may be passed through the slit 20.

The step of folding the first side flap 26 over the infant 12 may include the steps of pulling the first side flap end 28 such that the first side flap 26 is pulled taut and secure around the infant 12. The first side flap end 28 may be passed through the slit 20 prior to the step of pulling.

The first side flap end 28 may be secured to the outer surface 18 using the first fastening device 44. Preferably, this first fastening device 44, which may be a portion of hook and pile material, includes a mating fastener 46 as previously described. Thus, the first side flap end 28 may be pulled tight around the infant 12 and the first side flap end 28 attached to the outer surface 18 while the infant 12 is held tightly.

The second side flap 30 may then be folded around the infant 12 such that the second side flap 30 covers a portion of the first side flap 28 and surrounds the infant 12. The second side flap end 32 may then be secured to the outer surface 18 using the second fastening device 48 in a similar fashion to that described for the first side flap end 28. Alternatively, the second side flap end 32 may be folded around the first side flap 26 and connected with the first side flap end 28. This connection may be made using a third fastening device (not shown) or alternatively, through merely tying the first side flap end 28 and the second side flap end 32 together.

It will be understood that various modifications can be made to the various embodiments herein disclosed, without departing from the spirit and scope of the invention. For example, various sizes of the present infant blanket are contemplated as well as various types of construction materials. Also, various modifications may be made in the configuration of the side flaps and the associated slit. Therefore, the above description should not be construed as limiting the invention, but merely as an exemplification of preferred embodiments thereof. Those of skill in the art will envision other modifications within the scope and spirit of the present invention as defined by the claims appended hereto.

What is claimed is:

1. An article for wrapping an infant, said article comprising:

a sheet of flexible material having an inner surface for receiving the infant and an outer surface, said sheet of flexible material having in combination:

a central area extending between a first side and a second side, said central area having a slit disposed between said first side and said second side and extending between the inner and outer surfaces;

a first side flap extending outwardly from said first side of said central area to a first side flap end, said first side flap configured for folding around said infant and for inserting through said slit, and a second side flap extending outwardly from said second side of said central area to a second side flap end, said second side flap configured for folding over a portion of the first side flap and the infant.

2. The article as recited in claim 1 wherein said slit is a vertical slit disposed between said first side flap and said second side flap.

3. The article as recited in claim 2 wherein said slit is approximately between 2 and 4 inches in length.

4. The article as recited in claim 2 wherein said vertical slit is disposed closer to said second side flap than said first side flap.

5. The article as recited in claim 1 wherein said slit is a horizontal slit disposed between said first side flap and said second side flap.

6. The article as recited in claim 1 wherein said slit has a predetermined width.

7. The article as recited in claim 1 wherein said first side flap is a generally triangular shaped flap.

8. The article as recited in claim 1, and further comprising a fastener attached to said outer surface of said central area for releasably retaining said first side flap.

9. An article for wrapping an infant, said article comprising:

a sheet of flexible material having an inner surface for receiving the infant and an outer surface, said sheet of flexible material having in combination:

a central area extending between a first side and a second side, said central area having a slit disposed between said first side and said second side and extending between the inner and outer surfaces;

a first side flap extending outwardly from said first side of said central area to a first side flap end, said first side flap configured for folding around said infant and for inserting through said slit;

a second side flap extending outwardly from said second side of said central area to a second side flap end, said second side flap configured for folding over a portion of the first side flap and the infant;

an upper edge extending from the first side flap to the second side flap; and a lower edge extending from the first side flap to the second side flap, said lower edge configured with a pocket for receiving a portion of the infant.

10. The article as recited in claim 9 wherein said slit is a vertical slit disposed between said first side flap and said second side flap.

11. The article as recited in claim 9 wherein said first side flap comprises a generally triangular shaped flap.

12. The article as recited in claim 9 wherein said second side flap comprises a generally triangular shaped flap.

13. The article as recited in claim 9 and further comprising a collar connected to said upper edge.

14. The article as recited in claim 9 wherein said first side flap end is disposed between said upper edge and said lower edge.

15. The article as recited in claim 9 wherein said second side flap end is disposed closer to said upper edge that to said lower edge.

16. The article as recited in claim 9 wherein said upper edge is generally parallel to said lower edge.

17. A method for wrapping a baby wrapping blanket around an infant comprising the steps of:

providing a baby wrapping blanket made from a sheet of fabric material having a central area which extends from a first central area side to a first side flap and from an opposed second central area side to a second side flap, each of said side flaps extending outwardly from the central area to a corresponding first side flap end and a second side flap end, said central area having an inner surface for receiving the infant, an outer surface and a slit within the central area which extends between the inner surface and the outer surface;

placing the infant on the inner surface of the central area;

folding the first side flap over the infant;

extending the first side flap end through the slit in the central area;

folding the second side flap around the infant such that the second side flap covers a portion of the first side flap; and securing the first side flap and the second side flap relative to the outer surface of the central area.

18. The method as recited in claim 17 wherein the step of extending the first side flap end through the slit further comprises pulling the first side flap end such that the first side flap is pulled taut around the infant.

19. The method as recited in claim 17 wherein the step of securing comprises the steps of first securing the first side flap to the outer surface of the central area and then securing the second side flap to the outer surface.

20. The method as recited in claim 17 wherein the step of securing comprises the steps of removably connecting said first side flap to said second side flap.

* * * * *